US005176437A

United States Patent [19]

Remington

[11] Patent Number: 5,176,437

[45] Date of Patent: Jan. 5, 1993

[54] ANCHOR CLIP FOR PREVENTING TIPPING OF STORAGE CABINETS

[75] Inventor: John L. Remington, Coplay, Pa.

[73] Assignee: The Stanley Works, New Britain, Conn.

[21] Appl. No.: 667,425

[22] Filed: Mar. 11, 1991

[51] Int. Cl.[5] ..... A47B 91/00

[52] U.S. Cl. ..... 312/351.1; 248/500; 248/680

[58] Field of Search ..... 312/351.1, 351.5, 351.3; 248/500, 680, 681; 241/458, 290, 291

[56] References Cited

U.S. PATENT DOCUMENTS

| | | | |
|---|---|---|---|
| 670,763 | 3/1901 | Brodeur . | |
| 1,335,842 | 4/1920 | Lambert . | |
| 1,481,396 | 1/1924 | Ternes | 248/680 |
| 1,551,516 | 8/1925 | McGovern | 248/681 |
| 2,266,852 | 12/1941 | Cunningham . | |
| 2,798,271 | 7/1957 | Flora | 248/500 |
| 3,215,873 | 11/1965 | Kruger et al. | 248/500 X |
| 3,996,500 | 12/1976 | Conles | 248/500 X |
| 4,343,451 | 8/1982 | Armstrong | 248/500 |
| 4,669,695 | 6/1987 | Chon | 248/500 |
| 4,805,859 | 2/1989 | Hudson | 248/680 X |
| 4,890,813 | 1/1990 | Johnson et al. . | |

FOREIGN PATENT DOCUMENTS

| | | | |
|---|---|---|---|
| 1123232 | 8/1968 | United Kingdom | 24/290 |

OTHER PUBLICATIONS

Material Handling Equipment, Nov., 1990, p. 26.

Equipto Brochure 1990, Circle No. 300.

*Primary Examiner*—Kenneth J. Dorner

*Assistant Examiner*—Brian K. Green

*Attorney, Agent, or Firm*—Woodcock Washburn Kurtz Mackiewicz & Norris

[57] ABSTRACT

A system for preventing storage cabinets and the like from tipping when drawers of the cabinet are opened using an anchor clip for cooperating with the feet on the cabinet to latch the cabinet in vertical position.

9 Claims, 3 Drawing Sheets

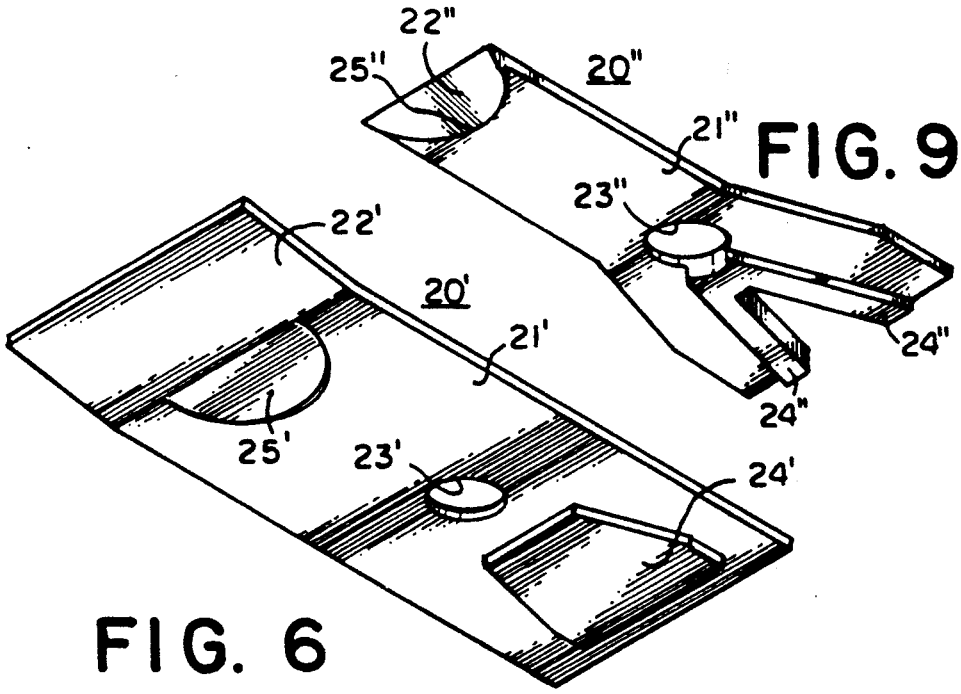
FIG. 9
FIG. 6
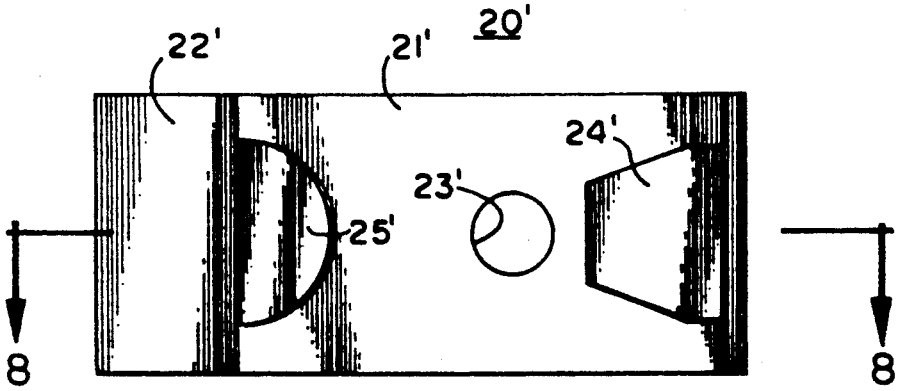
FIG. 7
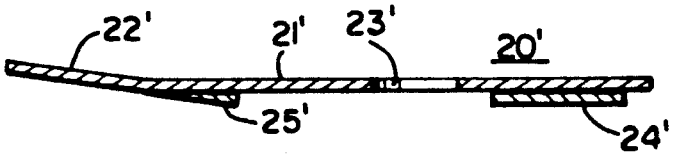
FIG. 8

ANCHOR CLIP FOR PREVENTING TIPPING OF STORAGE CABINETS

BACKGROUND OF THE INVENTION

The present invention relates to improvements in devices for preventing tipping of storage cabinets and the like when the drawers are opened and particularly to an anchor clip for cooperating with the feet on the cabinet to latch the cabinet in vertical position.

It has long been a problem to prevent storage cabinets from tipping when too many drawers are extended or where the extended weight exceeds the weight in cabinet housing. Various devices have heretofore been proposed for overcoming this problem. One of such devices has been referred to as "one drawer at a time". Devices of such type were built into the cabinets and were expensive, have malfunctions, can be over-ridden to defeat the purpose and, therefore, are not 100% effective. The problem of preventing storage cabinets from tipping is particularly critical where the cabinets have multiple drawers and contain very heavy objects. For example, for parts storage, modular drawer cabinets are used and they may have from 10 to 20 drawers with each drawer holding as much as several hundred pounds of parts. When an employee is filling an order from the stock room it is desirable that he be able to have more than one drawer of the cabinet open at one time so as to reduce the time required to fill each order. When several of these drawers filled with heavy parts are opened at the same time it can readily be seen that this presents a severe safety problem to prevent the cabinet from tipping and injuring the employee. Other types of devices have been used to prevent tipping and one of such is floor anchoring. The most common approach to floor anchoring has been to drill holes in the floor and install anchors, remove the drawers in the cabinet for access to the cabinet bottom, drill holes in the cabinet bottom above the floor anchors, install hold-down screws or bolts and then replace the cabinet drawers. Another approach has been to drill holes in the floor and attach a bracket thereto. The cabinet is moved into position so that the two bottom channels or feet on the cabinet slip over two extending arms of the bracket. The bottom drawer of the cabinet is removed and a locking bar bolted to the bottom of the cabinet. The bottom drawer is then replaced.

From the foregoing it will be seen that the majority of the anti-tipping devices have required removal of the drawers of the cabinet in order to secure the cabinet in position. It would be desirable to provide an anti-tipping device which would not require drawer removal or the attachment of an auxiliary bracket to complete the installation. It would be desirable to provide an anchor clip for preventing tipping of storage cabinets which anchor clip can readily be bolted to the floor and wherein the cabinet can be slid into place for cooperating with the anchor clips which automatically will latch the cabinet in position. It would further be desirable that the anchor clips be unlatched from the cabinet when desired without the necessity of removing any of the cabinet drawers.

SUMMARY OF THE INVENTION

It is an object of the present invention to provide an anchor clip for preventing tipping of storage cabinets and wherein the cabinet may be installed in anchored position with the clip without removing any drawers of the cabinet.

The present invention relates to an anchor clip for preventing tipping of storage cabinets of the type having at least one foot with a cut-out at the rear end thereof and a hole spaced inwardly therefrom. The anchor clip comprises a plate-like member having a hole therethrough intermediate the ends thereof for receiving an anchor bolt. A raised portion is provided on the underside of the plate-like member adjacent the rear end thereof to mate with the cut-out in the cabinet foot for positive alignment. A raised portion is provided on the underside of the plate-like member adjacent the front end thereof and shaped to be received in the hole in the cabinet foot to latch the cabinet in position.

In accordance with one aspect of the present invention the foot of the cabinet is provided with a "V" cut-out and a circular hole, the raised portion on the underside of the plate like member adjacent the rear end thereof is "V" shaped to mate with the "V" cut-out and the raised portion adjacent the front end thereof is a half-moon shaped portion for being received in the circular hole in the cabinet foot to latch the cabinet in position. The half-moon shaped portion of the plate may be lanced and form an extension of the raised front end portion of the plate-like member.

In accordance with another aspect of the invention there is provided a system for preventing storage cabinets and the like from tipping when drawers of the cabinet are opened. The cabinet is provided with a pair of spaced feet in the form of elongated channels for supporting the cabinet and the bottom of the channels have a rear end with a "V" notch and a hole spaced inwardly therefrom. An anchor clip is provided for each of the feet. Each anchor clip comprises a plate-like member having a hole for receiving an anchor bolt, a raised "V" portion on the underside of the plate-like member to mate with the "V" notch in the channels for positive alignment, and a raised portion on the underside of the plate-like member on the opposite side of the hole from the "V" portion for being received in the hole in the channel to latch the cabinet in position. An anchor bolt extends through the hole in each of the anchor clips and the "V" notch in each of the channels. The lower end of each anchor bolt is anchored in the floor supporting the channels of the storage cabinet. A threaded nut is received on the upper end of each anchor bolt and a lock washer is positioned on each anchor bolt between the anchor clip and the threaded nut to permit each of the channels to slide under the anchor clip to latch the cabinet in position.

BRIEF DESCRIPTION OF THE DRAWINGS

FIG. 6 is a bottom perspective view of another embodiment of the anchor clip.

FIG. 7 is a bottom plan view of the anchor clip shown in FIG. 6.

FIG. 8 a sectional view taken along the lines 8—8 in FIG. 7.

FIG. 9 a bottom perspective view of another embodiment of the anchor clip.

DESCRIPTION OF THE PREFERRED EMBODIMENT

Figure 1:
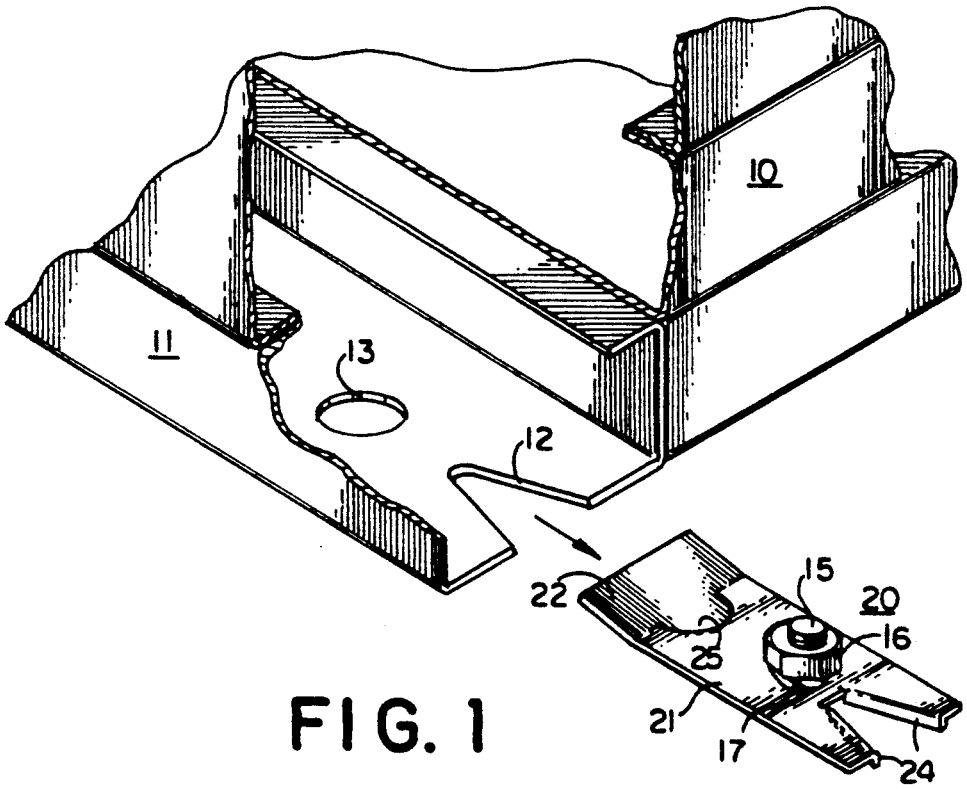
FIG. 1 is a partial perspective view of a cabinet and the foot thereof preparatory to being assembled with an anchor clip in accordance with the present invention.
Figure 2:
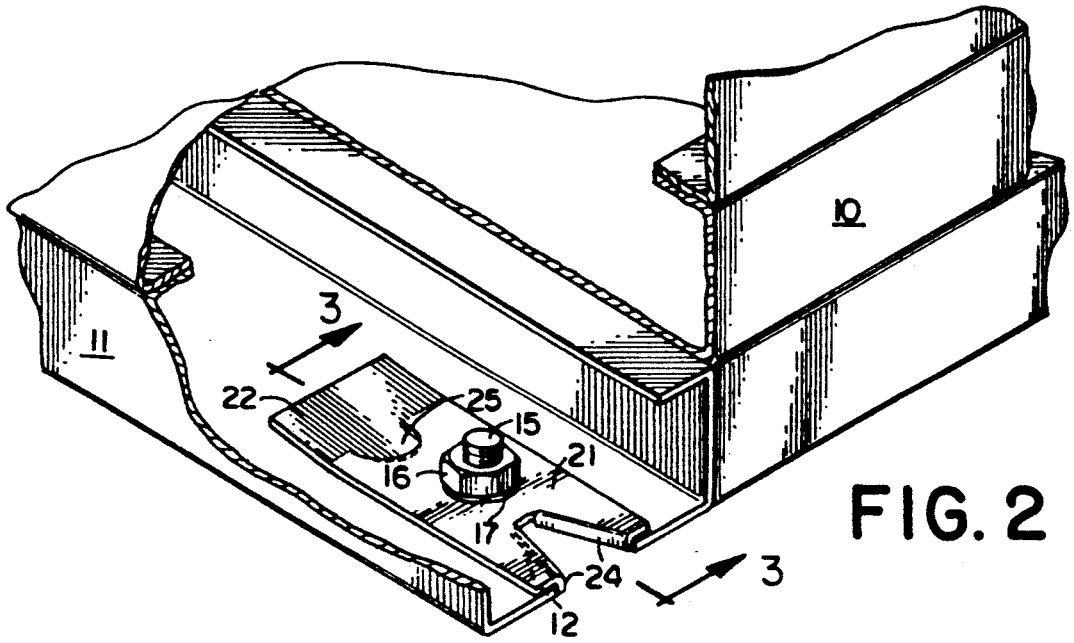
FIG. 2 is a partial perspective view showing the anchor clip of FIG. 1 assembled in an anchoring position with the foot of the cabinet.

Referring to FIG. 1 there is illustrated a partial view of a cabinet 10 of the type having multiple drawers, not shown. Cabinets of this type are conventionally provided with two bottom channel members 11, only one being shown, which serve as feet in supporting the cabinet 10. The cabinets are normally moved into position by means of a lift truck where the fork of the lift is inserted between the spaced channels 11 or the cabinet may be moved manually. It will be seen in FIG. 1 that the rear end of the channel 11 has been provided with a "V" notch or cut-out 12 on the bottom of the channel and a circular hole 13 spaced inwardly therefrom. The "V" cut-out 12 and the circular hole 13 of the foot 11 are adapted to cooperate with the novel anchor clip 20 as now to be described.

Figure 3:
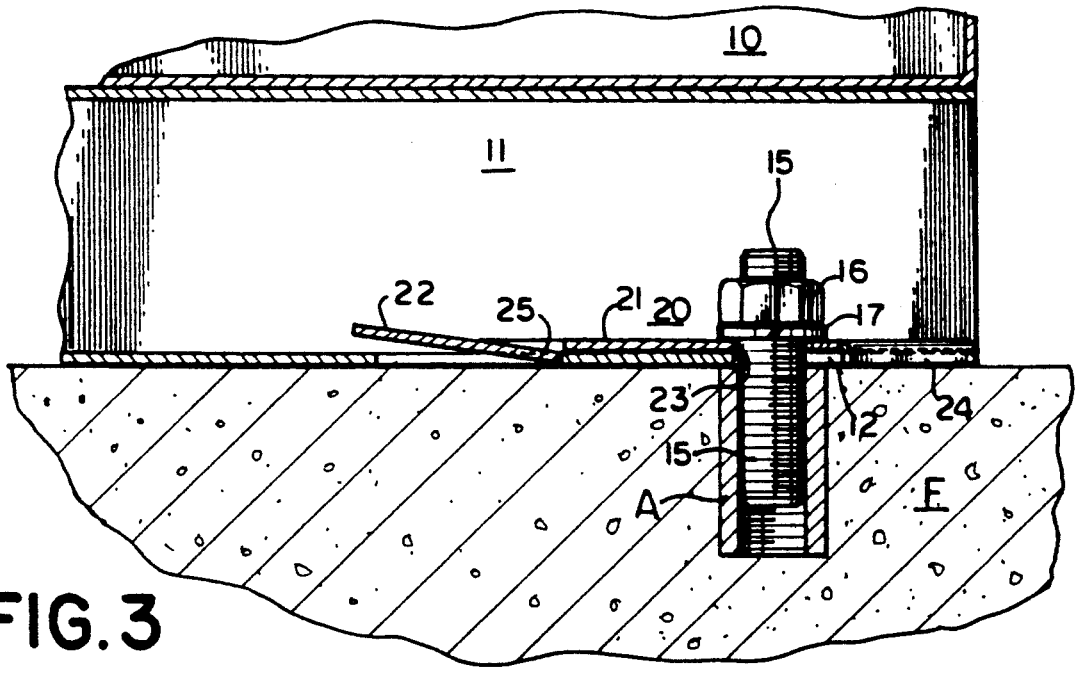
FIG. 3 is a sectional view taken along the lines 3—3 in FIG. 2.
Figure 4:
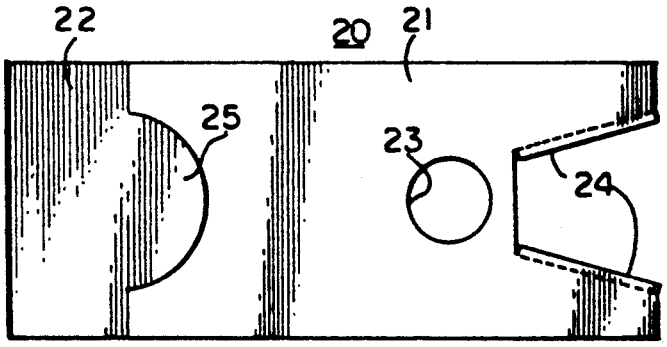
FIG. 4 is a top plan view of the anchor clip shown in FIGS. 1-3.
Figure 5:
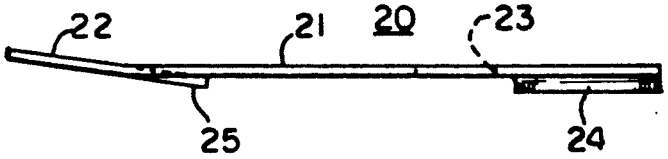
FIG. 5 is a edge view of the anchor clip shown in FIG. 4.

The anchor clip 20 is best shown in FIGS. 4 and 5 and comprises a plate-like member 21 having a raised front end 22 and a hole 23 therethrough intermediate the ends thereof for receiving an anchor bolt as hereinafter to be described. The anchor clip 20 has a raised "V" portion 24 on the underside of the plate-like member 21 adjacent the rear end thereof to mate with the "V" cut-out 12 in the cabinet foot 11 for positive alignment. As may be seen in FIGS. 1-5 the raised "V" portion 24 on the clip 20 has been formed by punching a "V" notch in the rear end of the plate-like member 21 and turning down shoulders on the sides of the "V" notch. The anchor clip 20 is also provided with a raised portion 25 on the underside of the plate-like member 21 adjacent the front end thereof and shaped to be received in the hole 13 in the cabinet foot 11 to latch the cabinet 10 in position. As shown in FIGS. 1-5 the raised portion 25 has been formed by a lancing operation and has a semi-circular or half-moon shape which is adapted to be received within the circular hole 13 in the foot 11 of cabinet 10. This is best seen in FIG. 3.

The installation of the anchor clips 20 will now be described An anchor clip 20 is secured to each of the two rear anchor bolts normally used to anchor the cabinet 10. Two rear bolts are sufficient to secure a cabinet. Only one channel foot 11 of the cabinet 10 has been illustrated in the drawings although it will be understood that the other foot on the other side of the cabinet would be similar thereto. Each clip 20 is placed over the respective anchor which has previously been installed in the floor. An example of an anchor A installed in the cement floor F is shown in FIG. 3. The rear bolt 15 extending from anchor A is inserted through the hole 23 in the anchor clip 20 and the nut 16 is secured finger tight therein with a lock washer 17. It will be noted in FIG. 1 that the lock washer 17 is in the expanded condition and not yet compressed. The clip 20 is relatively aligned with the front to back line of the cabinet 10 and particularly the channels or feet 11. The cabinet 10 is then pushed backwards in the direction of the clips 20 so that the rear end of the foot 11 with the "V" cut-out 12 passes under the raised front portion 22 of the clip 20. The "V" portion 24 of the clip 20 mates to the corresponding "V" cut-out 12 in the cabinet foot 11 which positively aligns the clip 20 so that as the backward motion of the cabinet is continued, it eventually allows the lanced half-moon shaped raised portion 25 to drop into the circular hole 13 in the cabinet foot 11 and latch the cabinet in position. The rearward movement of the cabinet 10 takes up the clearance in the lock washer 17 causing it to be compressed by raising the clip 20, FIG. 3. It also positively seats the half-moon raised portion 25 into the mating hole 13 in the cabinet foot 11. This action automatically results in securing the nut 16 firmly on the anchor bolt 15 wherein its removal is only possible with a wrench.

From the foregoing description it will be seen that the novel another clip 20 does not require the removal of the drawers of the cabinet to latch the cabinet in place nor does it require the attachment of an auxiliary bracket to complete the installation. The novel anchor clip 20 permits "blind" anchoring of a cabinet. Normally, if the back of the cabinet is against a wall or other obstruction, it is impossible to anchor the rear of the cabinet securely, and users just neglect to do it. The novel anchor clip 20 and its method of use permits anchoring of cabinets against obstruction without any problem. The novel anchor clip 20 is of one piece construction and thus relatively easy to manufacture. Furthermore, the removal of the cabinet 10 from its installed position with the anchor clip 20 does not require removing the drawers. The anchor clip 20 can be released by using a flat bar having a taper at one end which can be slipped under the raised front end 22 of the clip 20 from the front of the cabinet 10 through the hollow foot 11 thereby raising the impinged half-moon 25 from the opening 13 in the front 11 and allowing the cabinet 10 to be pulled forward.

As may be seen in FIGS. 1 and 3 the depth of the "V" cut-out 12 in the foot 11 is sufficient to receive both the anchor bolt 15 and the raised "V" portion 24 on the underside of the anchor clip 20. The circular hole 13 in the cabinet foot 11 likewise is positioned with respect to the bottom of the "V"$\pi$cut-out 12 so that the half-moon shaped portion 25 on the anchor clip 20 will drop into position in the circular opening 13.

While the anchor clip 20 described and illustrated in connection with FIGS. 1-5 is manufactured by a punch and lancing operation, it is to be understood that it may be manufactured by other techniques. One example is the embodiment illustrated in FIGS. 6-8. In FIGS. 6-8 the corresponding parts have been identified with corresponding reference characters with the addition of a prime. In the anchor clip 20' illustrated in FIGS. 6-8 the plate-like member 21' has been provided with a raised front end 22' and an intermediate hole 23' similar to that illustrated in FIGS. 1-5. The essential difference in the anchor clip 20' is that the half-moon shaped portion 25' and the raised "V" portion 24' are made from separate members which have been like member 21'. It is to be understood that the anchor clip 20' is adapted to be installed with the cabinet 10 and the foot 11 in the same manner as previously described in assembling the anchor clip 20 with the cabinet 10. While the anchor clips 20 and 21' described herein are preferably manufactured from sheet steel, it is also to be understood that the anchor clip may be manufactured by casting.

Another embodiment of the novel anchor clip has been illustrated in FIG. 9. The anchor clip 20" illustrated in FIG. 9 has the corresponding parts thereof identified with corresponding reference characters with the addition of a double prime. The anchor clip 20"

includes a plate-like member 21″ provided with a front end 22″ which is inclined upwardly. The plate-like member 21″ is also provided with an intermediate hole 23″. The underside of the plate-like member 21″ is provided with a half-moon shaped portion 25″ adjacent the front end and a raised "V" portion 24′40 adjacent the rear end of the plate-like member 21″. It is to be understood that the anchor clip 20″ is adapted to be installed with the cabinet 10 and the foot 11 in the same manner as previously described in assembling the anchor clips 20 and 20′ with the cabinet 10.

While a preferred embodiment of the invention has been described and illustrated, it is to be understood that further modifications thereof may be made within the scope of the appended claims without departing from the spirit of the invention.

What is claimed is:

1. An anchor clip for preventing tipping of storage cabinets of the type having at least one foot with a "V" cut-out at a rear end thereof and a hole spaced inwardly therefrom, said anchor clip comprising a plate-like member having a hole therethrough intermediate the ends thereof for receiving an anchor bolt, a raised "V" portion on the underside of said plate-like member adjacent the rear end and extending longitudinally thereof, to mate with the "V" cut-out in the cabinet foot for positive alignment, and a raised portion on the under side of said plate-like member adjacent the front end thereof and shaped to be received in the hole in the cabinet foot to latch the cabinet in position.

2. An anchor clip according to claim 1 wherein the front end of said plate-like member on the underside is inclined upwardly.

3. An anchor clip according to claim 1 wherein the hole in said foot is circular and said raised portion on the underside of said plate-like member adjacent the front end thereof is half-moon shaped so as to be received in the circular hole in the cabinet foot.

4. An anchor clip according to claim 3 wherein said raised portion on the underside of said plate-like member adjacent the front end thereof is a lanced, half-moon shaped member.

5. An anchor clip for preventing storage cabinets from tipping when drawers of the cabinet are opened, the cabinet having a pair of spaced feet for supporting the cabinet, the bottom of the feet having a rear end with a notch and a hole spaced inwardly therefrom, said anchor clip comprising a plate-like member having a hole for receiving an anchor bolt, a raised portion on the underside of said plate-like member adjacent the rear end thereof to mate with the notch in the cabinet foot for positive alignment, and a second raised portion on the opposite side of said hole from said first-named raised portion, said second raised portion being shaped for being received in the hole in the cabinet foot to latch the cabinet in position.

6. A system for preventing storage cabinets from tipping when drawers of the cabinet are opened, the cabinet having a pair of spaced feet in the form of elongated channels for supporting the cabinet, the bottom of the channels having a rear end with a "V" notch and a hole spaced inwardly therefrom, an anchor clip for each of said feet, each anchor clip comprising a plate-like member having a hole for receiving an anchor bolt, a raised "V" portion on the underside of said plate-like member to mate with the "V" notch in the channels for positive alignment, and a raised portion on the underside of said plate-like member on the opposite side of said hole from said "V" portion for being received in the hole in the channels to latch the cabinet in position.

7. A system according to claim 6 including an anchor bolt extending through the hole in each said anchor clip and the "V" notch in each of the channels, the lower end of each said anchor bolt being anchored in the floor supporting the channels of the storage cabinet, a threaded nut on the upper end of each said anchor bolt, and a lock washer on each said anchor bolt between said anchor clip and said threaded nut to permit each of the channels to slide under said anchor clip to latch the cabinet in position.

8. A method of using the system according to claim 7 comprising the steps of aligning the anchor clips relative to the rear end channels of the cabinet, pushing the cabinet backwards in the direction of the clips so that the bottom rear end of the channels pass under the raised portion of the clips and the "V" portion of the clips mate to the "V" notch in the channels thereby positively aligning the clips so that as the backward motion of the cabinet is continued it allows the raised portion on the underside of the clips to be received in the holes in the channels and thereby latch the cabinet in position.

9. A system according to claim 6 wherein the hole in the bottom of the channels is circular and the raised portion on the underside of the plate-like member on the opposite side of the hole from the "V" portion is half-moon shaped for being received in the circular hole in the channels.

* * * * *